United States Patent [19]

Fyler et al.

[11] Patent Number: 5,005,823

[45] Date of Patent: Apr. 9, 1991

[54] CORNER ALIGNMENT SYSTEM

[75] Inventors: Donald C. Fyler, Cambridge; Edward A. Van Duyne, Framingham; Michael G. Kelly, Arlington, all of Mass.

[73] Assignee: The Charles Stark Draper Laboratory, Inc., Cambridge, Mass.

[21] Appl. No.: 376,391

[22] Filed: Jul. 6, 1989

[51] Int. Cl.[5] ..... B65H 7/02

[52] U.S. Cl. ..... 271/228; 294/907; 414/752; 414/750; 901/47; 271/102; 271/108

[58] Field of Search ..... 271/227, 228, 254, 255, 271/102, 108, 230, 231; 294/907; 414/752, 751, 750; 901/46, 47

[56] References Cited

U.S. PATENT DOCUMENTS

| | | | |
|---|---|---|---|
| 3,888,362 | 6/1975 | Fletcher et al. | 901/47 |
| 4,105,925 | 8/1978 | Rossol et al. | 901/47 |
| 4,714,400 | 12/1987 | Barnett et al. | 414/751 |
| 4,724,480 | 2/1988 | Hecker et al. | 901/47 |
| 4,812,666 | 3/1989 | Wistrand | 901/47 |
| 4,905,978 | 3/1990 | Polic | 271/227 |

*Primary Examiner*—H. Grant Skaggs
*Attorney, Agent, or Firm*—Lahive & Cockfield

[57] ABSTRACT

A system for locating a corner of an angularly oriented workpiece on a worksurface includes a gripper and associated two axis transport assembly, and a set of sensors on the gripper for detecting reflected radiation from the workpiece and surrounding work. A controller translates the gripper in the directions of two orthogonal axes until the sensors each overlie an edge of the corner-to-be detected. In the preferred form, the transport assembly includes a pneumatic position control system for each axis. Each pneumatic position control system includes an air cylinder and associated piston, a position valve assembly and a controller, and may further include a velocity valve assembly. The controller may control the position valve assembly to be in a first state during a selected time interval, thereby establishing axial motion of the piston in a first direction during that interval. Alternatively, the controller may control the position valve assembly to be in a second state during a selected time interval, thereby establishing axial motion of the piston in a second direction during that interval. The controller may also establish substantially no motion of the piston during a selected interval by alternately controlling the position valve assembly to be in its first state and its second state during the time interval. The velocity valve assembly controls the pneumatic impedance in the coupling path to the cylinder in order to selectively establish desired velocity for piston motion.

10 Claims, 4 Drawing Sheets

CORNER ALIGNMENT SYSTEM

REFERENCE TO RELATED PATENT APPLICATION

The subject matter of this application is related to that of U.S. Pat. application Ser. No. 376,425, entitled "Digital Pneumatic Position Control System", filed on even date herewith.

FIELD OF THE INVENTION

This invention relates to the assembly of seamed articles made from limp material, such as fabric. In particular, the invention relates to systems for automated, or computer-controlled, assembly of seamed articles from limp material.

BACKGROUND OF THE INVENTION

Conventional assembly line manufacture of seamed articles constructed of limp fabric consists of a series of manually controlled assembly operations. Generally tactile presentation and control of the fabric-to-be-joined is made to the joining, or sewing, head under manual control. One drawback of this application technique is that the technique is labor intensive; that is, a large portion of the cost for manufacture is spent on labor. To reduce cost, automated or computer-controlled manufacturing techniques have been proposed in the prior art.

In the course of implementing such automated techniques, it is often necessary to locate and then precisely align a "corner" of an angularly oriented limp material workpiece with a reference position on a work surface. For the purposes herein, the term "corner" refers to a portion of a workpiece bounded by a generally convex peripheral edge, although that edge may include minor non-convex portions. The peripheral edge may be continuous or piecewise continuous (e.g. as may be formed by two straight edges extending to a common point).

In the prior art, angularly oriented segments have been slidingly translated in one or two directions on a work surface by an array of parallel endless belts driven by electric motor assemblies, for example as shown in U.S. Pat. No. 4,632,046. However, precise control and alignment of corners of limp material segments has not been accomplished. Moreover, prior art position control systems for controlling the position of a workpiece typically utilize stepper motor arrangements and/or DC motors in a servo loop arrangement. These systems utilize a controller, a driver, a feedback sensor, and a motor. In addition, appropriate electronics are required to integrate the elements into an operable system. These systems tend to employ extremely complex electrical and mechanical designs having inherent disadvantages, for example, heat dissipation constraints of the motors. Furthermore, these systems tend to be expensive and consume large quantities of electrical power during operation.

As an alternative approach in the prior art, pneumatic systems may be employed to position various objects. Conventional pneumatic positioning systems typically utilize a control unit, a pressurized pneumatic source, and a plurality of solenoid air valves coupled with a brake mechanism to axially control the relative position an air cylinder with respect to an associated rod. The solenoid valves generally are comprised of a direction valve for establishing the direction of the air cylinder travel, and may also include one or more velocity valves for establishing desired velocities of air cylinder travel. The control unit controls the solenoid air valves to move the air cylinder to a desired location with respect to the rod. Once the air cylinder has attained the desired spatial location relative to the rod, the control unit activates the brake mechanism, for example an air brake, to maintain the position of the air cylinder relative to the rod.

A primary shortcoming of the conventional pneumatic positioning systems is the limited response time of the air cylinder. In particular, these systems tend to respond slowly to commands from the control unit after the brake mechanism is activated. This shortcoming is due primarily to the limited and slow response of the brake mechanism, for example an air brake. After activation of the brake, it must be deactivated, which generally requires depressurization. Once the air brake is deactivated the system can then be directed to a new position.

There exists a need for low cost position control systems for finding and then controlling the position of corners of an oriented limp material segment.

SUMMARY OF THE INVENTION

The present invention is a system for locating a corner of an angularly oriented segment of a limp material workpiece on a worksurface. Preferably the worksurface is substantially planar and is characterized by a first reflectivity, with the workpiece being characterized by a second reflectivity. The system includes a movable workpiece gripper which overlies the worksurface. The gripper is adapted to selectively grip the workpiece. A two axis transport assembly maintains the angular orientation of the gripper with respect to the worksurface. The transport assembly is responsive to applied position control signals for selectively positioning the gripper with respect to the worksurface in the direction of a first reference axis and for selectively positioning the gripper with respect to the worksurface in the direction of a second reference axis, where the first and second axes are parallel to the worksurface.

The system is adapted to direct radiation toward the workpiece and the worksurface from above the worksurface. Preferably, the radiation is optical in the visible or infra-red spectrum, but other radiation may be used.

A first sensor is affixed to the gripper. That sensor detects the radiation reflected from portions of the workpiece and the worksurface and underlying a first region associated with the gripper. The sensor generates a first sensor signal representative of the detected radiation.

A second sensor is affixed to the gripper and spaced apart in both the first and second direction from the first sensor. The second sensor detects radiation reflected from portions of the workpiece and the worksurface underlying a second region associated with the gripper. The second sensor generates a second sensor signal representative of the detected radiation.

A controller is responsive to the first and second sensor signals for translating the gripper over said worksurface in the direction of the first reference axis until a transition in the intensity of detected radiation is identified by the first sensor, and in the direction of the second reference axis until a transition in the intensity of detected radiation is identified by the second sensor. When the gripper is positioned so that both sensors detect such transitions, the gripper overlies the predetermined corner of the oriented workpiece. The gripper may selectively be actuated to grip the identified corner and then may be translated to re-position that corner, as desired.

In the preferred form of the invention, the two axis transport assembly includes a pair of pneumatic position control systems for controlling motion in the direction of each of the two axes. Other types of position controllers may be used in alternative embodiments.

In the preferred embodiment, where pneumatic position control systems are used, each control system includes an air cylinder, a position valve assembly and a controller. It may further include a velocity valve assembly. Generally, the air cylinder includes a first port and a second port and has an air cylinder having a piston adapted for motion therein along an axis. The piston moves in a first direction along the axis in response to a pressure differential having a first polarity applied across the first and second ports, and moves along in a second direction along the axis in response to a pressure differential having a second polarity applied across the said first and second ports.

The position valve assembly is operative in a first state to selectively couple the first port to a first air pressure and the second port to a second air pressure, and in a second state to selectively couple the first port to the second air pressure and the second port to the first air pressure.

The controller is adaPted to control the state of the position valve assembly. The controller may control the position valve assembly to be in its first state during a selected time interval, thereby establishing axial motion of the piston in the first direction during that interval. Alternatively, the controller may control the position valve assembly to be in its second state during a selected time interval, thereby establishing axial motion of the piston in the second direction during that interval. The controller may also establish substantially no motion of the piston during a selected interval by alternately controlling the position valve assembly to be in its first state and its second state during the time interval.

In forms of the pneumatic position control system having a velocity valve assembly, the latter assembly is responsive to the controller in a first state to selectively control the pneumatic impedance in the coupling path between at least one of the first and second ports, and the air pressure coupled thereto, to be a selected one of at least two predetermined values, and in a second state for controlling the pneumatic impedance in that coupling path to be another selected one of the predetermined values. The controller is adapted to selectively control the velocity valve assembly to be in its first state, thereby establishing a first velocity for the motion of the piston, or control that valve assembly to be in its second state, thereby establishing a second velocity for the motion of the piston.

Various embodiments may also include an encoder for generating an actual position signal representative of the position of the piston along its axis. This encoder may form part of a servo loop which is responsive to the actual position signal, and a signal representative of a desired position, to control the position valve assembly so that the piston is moved to and then maintained substantially at the desired position. Alternatively, the system of the invention may be operated in an open loop configuration.

With the invention, an accurate high efficiency, high reliability, low complexity position control system may be established using low cost components.

BRIEF DESCRIPTION OF THE DRAWINGS

The foregoing and other objects of this invention, the various features thereof, as well as the invention itself, may be more fully understood from the following description, when read with the accompanying drawings in which.

DESCRIPTION OF THE PREFERRED EMBODIMENT

Figure 1:
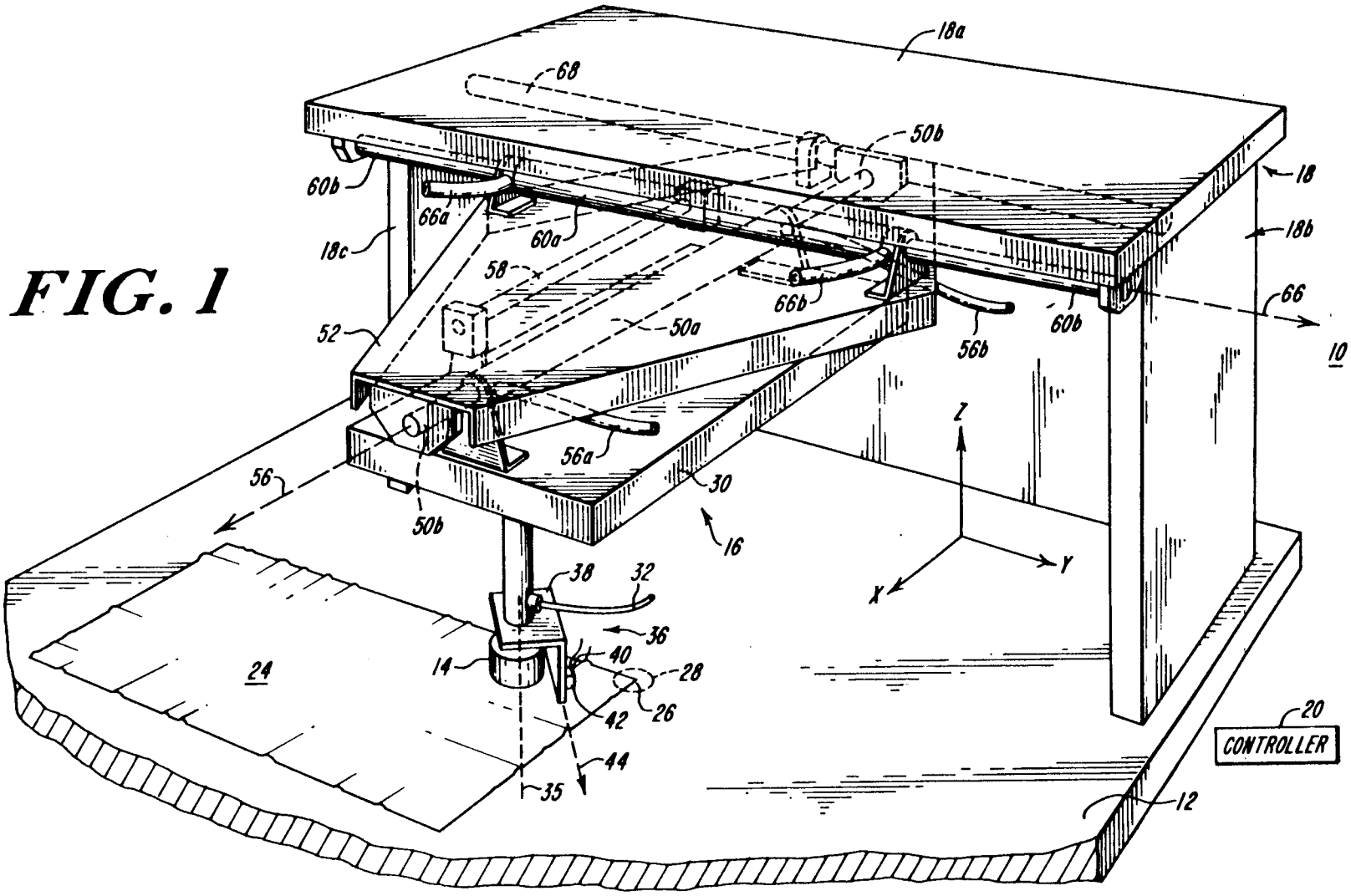
FIG. 1 shows in perspective view, a corner alignment system embodying the present invention.
Figure 3:
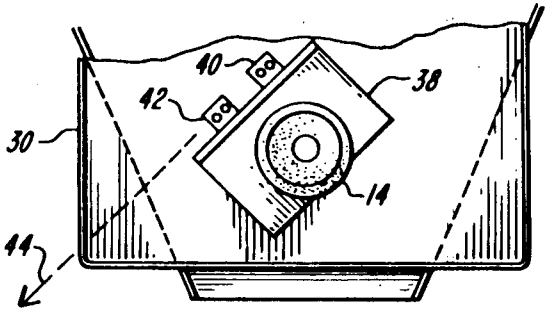
FIG. 3 shows a bottom plan view of the gripper of the system of FIG. 1.
Figure 2:
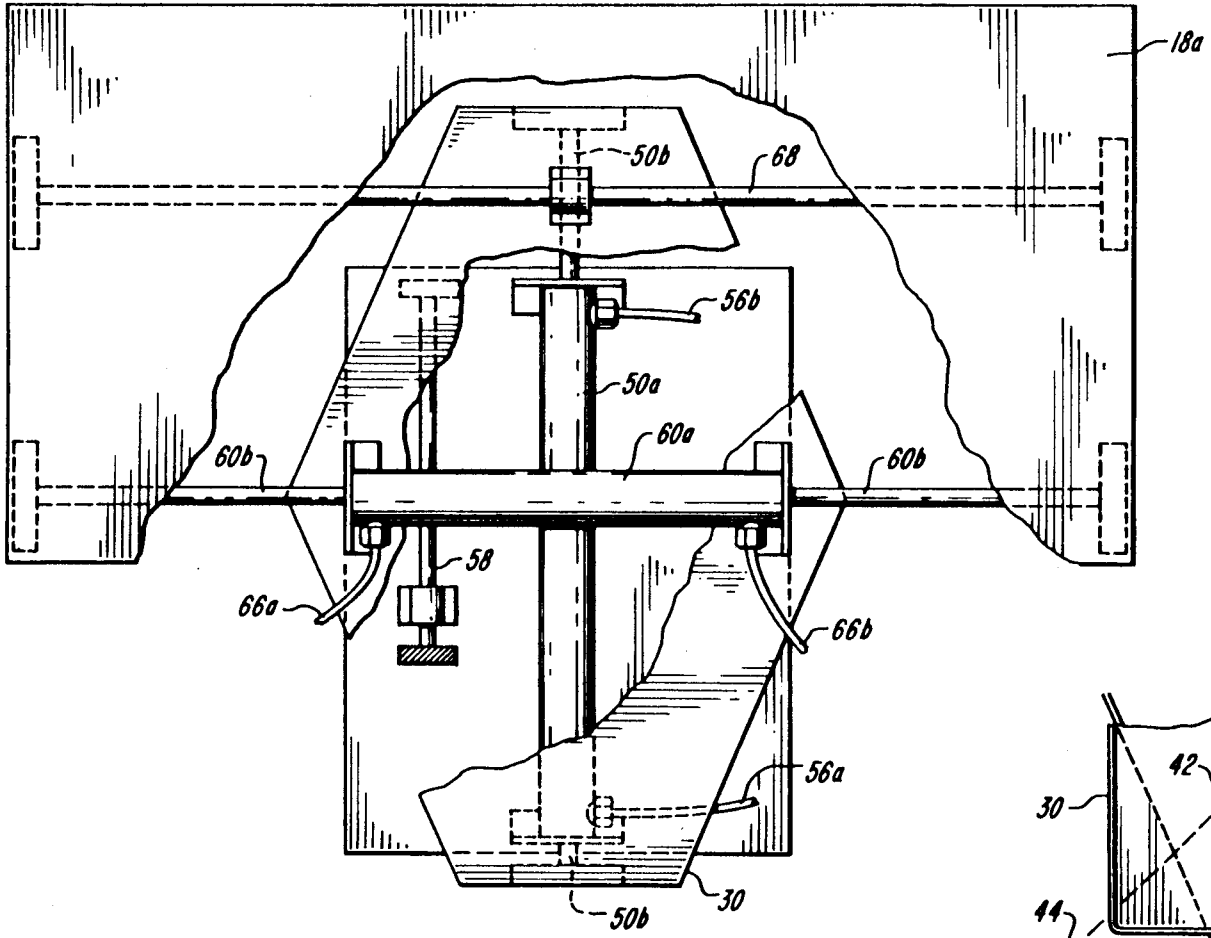
FIG. 2 shows a top plan view of the system of FIG. 1.

FIGS. 1–3 show a corner identification and alignment system 10 in accordance with the present invention. The system 10 includes a substantially planar worksurface 12, a gripper 14, a two-axis, pneumatic gripper positioning assembly 16 and gripper support assembly 18 and a controller 20. A reference X-Y-Z coordinate system is shown with its X- and Y-axes parallel to the worksurface 12 and the Z-axis being vertical.

In FIG. 1, an exemplary limp material workpiece 24 is shown on worksurface 12 with a corner-to-be-identified 26 being denoted by the broken circle 28. The workpiece is characterized by a relatively low optical reflectivity compared to the optical reflectivity of the worksurface 12. The workpiece 24 has a predetermined orientation as shown on the worksurface 12. The system 10 is adapted to locate and re-position, if desired, the corner 26 of the workpiece 24.

In the illustrated embodiment, the gripper 14 includes a vertically oriented, hollow bore cylindrical vacuum pick-up device, extending downward from a support plate 30 and vertically spaced apart slightly from the upper surface of the workpiece 24. The pick-up device is selectively actuated by application via vacuum line 32 of a low pressure to the interior of the pick-up device. The gripper 14 is oriented in a fixed angular position about its vertical central axis 35.

A sensor assembly 36 is fixedly attached to the gripper 14. Sensor assembly 36 includes an L-shaped support member 38 which supports two optical source/sensors 40 and 42 (each including an optical source and an optical sensor) so that they face the worksurface 12. The sensors 40 and 42 are positioned along a sensor axis 44 extending parallel to the worksurface 12 and at a predetermined angle with respect to the X-axis. The sensors 40 and 42 are electrically coupled to the controller 20.

The illustrated embodiment is adapted to identify right angle "corners" having an edge aligned with each of the X- and Y-axes. With this configuration, the sensor axis 44 is angularly offset from the X-axis by an angle of 45 degrees.

In other embodiments, different sensor configurations may be used for other "corner" definitions. A "corner" on a workpiece is defined as a continuous, generally convex peripheral edge, although that edge may include minor non-convex regions. The corner may be formed by straight edges extending from a common point (i.e. a piecewise continuous corner), as illustrated in FIG. 1.

The gripper 14 (and associated sensor assembly 36) is coupled to the gripper support assembly 18 (including horizontal support member 18*a* which is positioned above worksurface 12 by vertical support members 18*b* and 18*c*) by the two axis pneumatic positioning assembly with this configuration, the gripper 14 is maintained at a substantially constant angular orientation with respect to work surface 12. The positioning assembly 16 includes an X-axis actuator assembly and a Y-axis actuator assembly.

The X-axis actuator assembly includes a double ended air cylinder actuator 50 having its cylinder 50*a* affixed to support plate 30 and both ends of its rod 50*b* affixed to a support plate 52, so that the plate 30 (and the gripper 14) is selectively movable (in response to applied pressure differentials across pneumatic lines 56*a* and 56*b*) along an axis 56 (parallel to the X-axis) with respect to plate 52. The Y-axis actuator assembly includes a double ended air cylinder actuator 60 having its cylinder 60*a* affixed to support plate 62 and the ends of its rod 60*b* affixed to the respective support members 18*b* and 18*c*, so that plate 52 (and plate 30 and gripper 14) is selectively movable (in response to applied pressure differentials across pneumatic lines 66*a* and 66*b*) along axis 68 (parallel to the Y-axis) with respect to support members 18*a*, 18*b* and 18*c* and to worksurface 12. Idler shafts 58 and 68 (and couplings) are shown to maintain the illustrated angular orientations of the respective plates 30 and 52. Other configurations might alternatively be used. The detailed operation of the X- and Y-axis actuator assemblies is set forth below in conjunction with FIGS. 5 through 7.

In operation, to locate a corner of the workpiece 24, the controller 20 controls the X- and Y-axis actuator assemblies to begin at a reference location, preferably over the workPiece 24 (such as in the lower left corner as shown in FIG. 1). In the presently described embodiment, encoders may be used to identify the location of the gripper 14 to the controller 20. Then the controller 20 controls both actuator assemblies to establish motion of the gripper 14 over the worksurface 12, while constantly monitoring the level of light detected by the sensors of source/sensors 40 and 42. The motion is continued until both of those sensors detect a change in the level of detected light (which is indicative of the respective sensors passing over an edge of the workpiece 24).

In the present embodiment, the gripper 14 is driven (1) in the +X direction whenever the sensor 40 overlies the workpiece 24 and in the −X direction otherwise, and (2) in the +Y direction whenever the sensor 42 indicates that it overlies the workpiece 24 and in the −Y direction otherwise, until the controller 20 determines that the gripper is repetitively cycling a minimum distance in both the X and Y directions, thereby indicating that the gripper 14 overlies the Corner 24.

Figure 4:
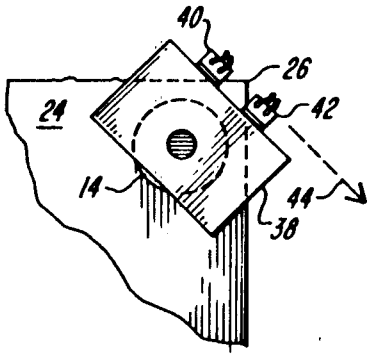
FIG. 4 illustrates the gripper of the system of FIG. 1 positioned over a corner of an exemplary workpiece.

Thus, at the time both sensors identify edges of the workpiece 24 (i.e. at the location illustrated in FIG. 4), the controller determines that the corner 26 has been located. Then, if desired, the pick-up device may be actuated to "grab" the corner and the X- and Y-axis actuators may be controlled to re-position the corner.

Figure 5:
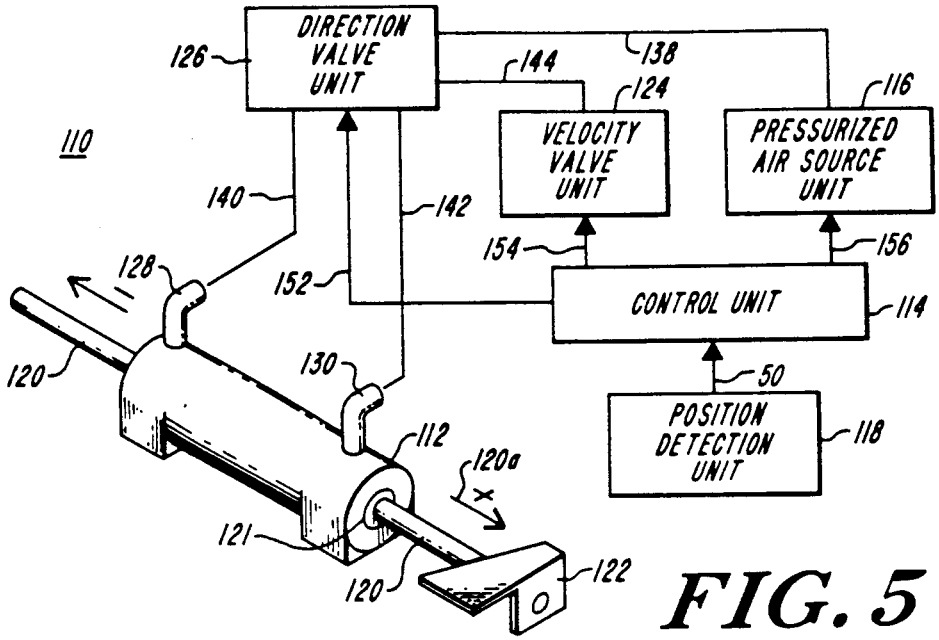
FIGS. 5 and 5A are schematic block diagrams representative of the individual components of the pneumatic actuators of the preferred embodiment of the present invention.

FIG. 5 shows a pneumatic position control system 110 adapted for driving each axis of motion for the two axis transport assembly of the present invention. System 110 includes an air cylinder 112, including a first port assembly 128 and a second port assembly 130, and including a rod 120 extending from a piston (interior to the housing of cylinder 112) along an axis 120*a*. The system 110 also includes a control unit 114, a pressurized air source unit 116, a position detection unit 118, a velocity valve unit 124, and a direction valve unit 126.

The air cylinder 112 and rod 120 of the present embodiment is a conventional double rod air cylinder having a housing defining an elongated cylindrical interior chamber, and having a piston in that chamber. The internal piston is adapted for motion along axis 120*a* in response to a pressure differential applied between port assemblies 128 and 130. Each end of rod 120 passes through a respective endwall of the housing. The endwall supports a seal 121 (preferably a lip seal) to pneumatically isolate the chamber interior from the regions outside the cylinder. In the illustrated embodiment, the rod 120 is adapted to be affixed (via connector 122) to a stationary base while cylinder may be moved relative to the base. Alternatively, the cylinder 112 may be so affixed, so that the rod 120 may be moved relative to the base. The use of a lip seal is particularly advantageous to precision control since that type of seal establishes relatively low sliding frictions and relatively high static friction between rod 120 and the housing. Pressurized air source unit 116 is pneumatically connected, via line 138 and through direction valve unit 126 and via line 140, to a first port assembly 128. The second port assembly 130 is pneumatically connected, via line 142 through direction valve unit 126 and via line 144, to velocity valve unit 124 and then to the atmosphere (as described below in conjunction with FIGS. 7A and 7B).

Control unit 114 is electrically connected, via line 150, to position detection unit 118. Control unit 114 is also electrically connected, via line 152, to direction valve unit 126. In addition, control unit 114 is electrically connected, via line 154, to velocity valve unit 124. Furthermore, control unit 114 is electrically connected, via line 156, to pressurized air source unit 116.

Figure 5A:
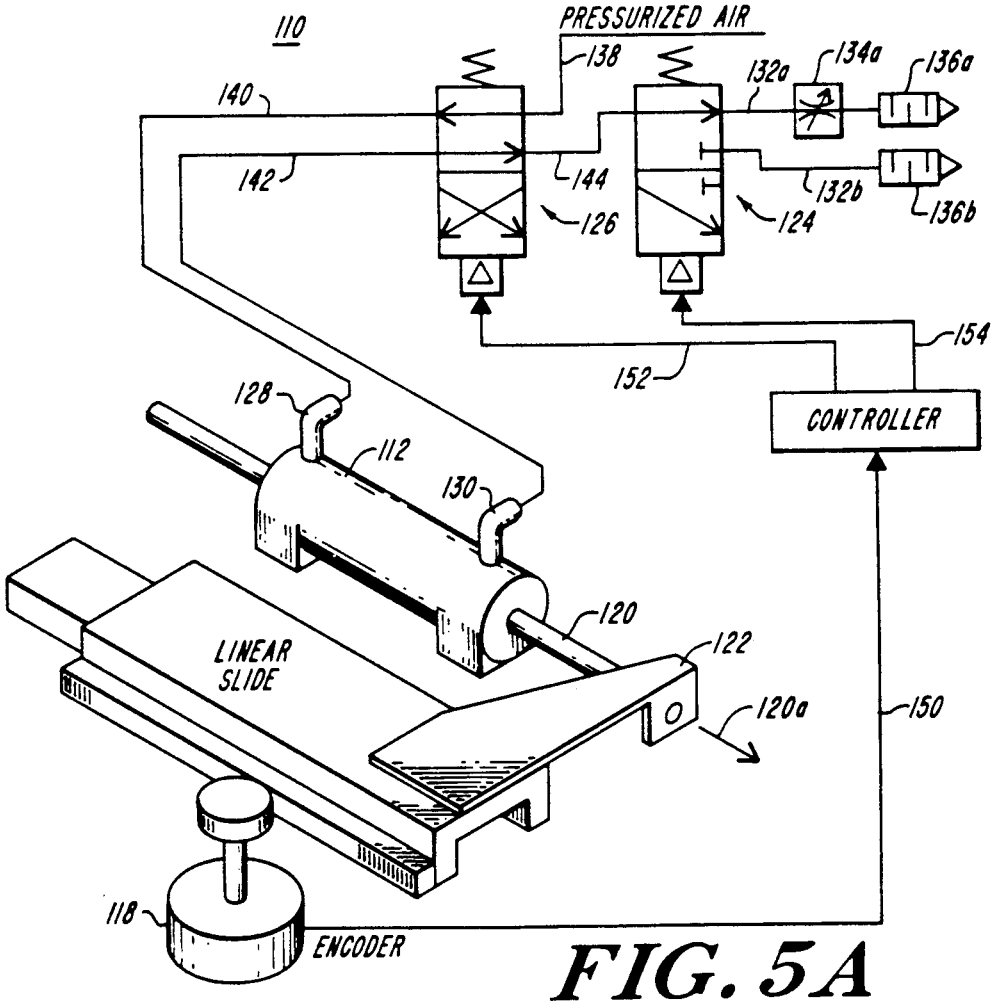

FIG. 5A shows a similar embodiment to that FIG. 5, but where the rod 120 is coupled to a linear slide 125. Elements in FIG. 5A that correspond to elements in FIG. 5 are identified with the same reference.

In operation, system 110 utilizes control unit 114 to control direction valve unit 126 and velocity valve unit 124, and thus establish and control the direction and velocity of the axial motion of air cylinder 112 with respect to rod 120. When air cylinder 112 is at the desired spatial location on rod 120, control unit 114 toggles the state of direction valve unit 126 and thus substantially maintains the spatial location of air cylinder 112 with respect to rod 120.

In particular, control unit 114, in response to a desired position input, for example by a user, generates a position error signal which is defined as the difference between the desired position and the actual position of air cylinder 112, determined by position detection unit 118, for example an optical encoder. In response to the comparison result, control unit 114 commands direction valve unit 126 to establish the motion of air cylinder 112 with respect to rod 120 in either the positive direction or the negative direction. The direction of motion is dependent upon the polarity of the position error signal. If the error position signal is positive, then direction valve unit 126 is commanded to provide motion of air cylinder 112 in the positive direction along rod 120. Conversely, if the error position signal is negative, then direction valve unit 126 is commanded to provide motion of air cylinder 112 in the negative direction. Thus, the direction valve unit 126, in response to commands from control unit 114, establishes a direction of motion of air cylinder 112.

In addition, control unit 114 further commands velocity valve unit 124 to establish a velocity of travel of air cylinder 112 with respect to rod 120. This velocity control is established by controlling the pneumatic flow rate along the pneumatic lines going to and leading from port assemblies 128 and 130. In order to provide for a relatively high velocity, a relatively low pneumatic impedance is established, and to provide for a relatively low velocity, a relatively high pneumatic impedance is established. Although only two velocities are provided for in the present embodiment, other embodiments may incorporate any desired number of velocities. The velocity may alternately be controlled by appropriate selection of the duration and frequency of the operation of the valves.

In the illustrated embodiment, the controller 114 automatically selects the velocity based upon absolute value of the error position signal. If the absolute value of the error position signal is greater than a predetermined value, then velocity valve unit 124 incorporates a pneumatic impedance that provides high flow through pneumatic line 144. When pneumatic impedance value unit 124 provides for a high flow, then air cylinder 112 has a high velocity. However, if the absolute value of the error position signal is less than a predetermined value, then pneumatic impedance valve unit 124 incorporates a pneumatic impedance that provides low flow through pneumatic line 144. When velocity valve 124 provides for a low flow, then air cylinder 112 has a low velocity. Thus, the velocity valve unit 124, in response to commands from control unit 114, establishes a velocity of air flow which is reflective of the length of travel of air cylinder 112 from the actual position to the desired position.

It should be noted that the predetermined velocity that is actually attained is dependent upon load encountered, including the mass of the moving body which includes air cylinder 112 (or the rod 120) and any other objects connected thereto, the average travel of air cylinder 112 (or rod 120), the pressure of the pressurized gas of the piston/cylinder assembly of air source unit 116, and the size of air cylinder 112.

Control unit 114 continually receives position information, representative of the position of air cylinder 112 with respect to rod 120, from position detection unit 118. In response to the new position information, control unit 114 is continually generating an updated error position signal. In addition, control unit 114 is continually updating the status of the velocity valve unit 124 in response to the absolute value of the updated error position signal.

Once air cylinder 112 reaches the desired position, control unit 114 commands direction valve unit 126 to periodically change the direction of motion of air cylinder 112 and thereby substantially maintain the desired position. Thus air cylinder 112 is substantially maintained in a spatial location by toggling between the two states of direction valve unit 126. By selectively controlling the duration and frequency of the actuating intervals for the respective valves, the control unit 114 can select the degree of precision by which it controls the position of the cylinder 112 with respect to rod 120.

In the illustrated embodiment, the toggle rate of direction valve unit 126 may be 10 msec while the response rate of direction valve unit 126 may be 4 msec. System 110 utilizing this toggle rate may maintain a position on rod 120 within a range of a few hundredths of a inch.

Control unit 114 can also selectively adapt the threshold desired for the switchover between velocities in order to attain desired performance levels, for example to provide for deceleration before reaching an end point so that there is minimal overshoot.

Control unit 114 may selectively control air source unit 116 by way of line 156 in order to provide a desired pressure differential between port assemblies 128 and 130. While the illustrated embodiment operates on the pressure differential between the output of source 116 and the atmosphere, other embodiments may use two different pressure sources, or may interchange the position of the pressure source 116 and the coupling of valve 126 to the atmosphere.

Figure 6A:
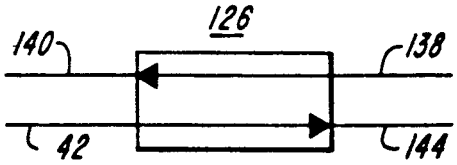
FIGS. 6A and 6B are schematic diagram representations of the two state direction valve unit of the actuator of FIG. 5.
Figure 6B:
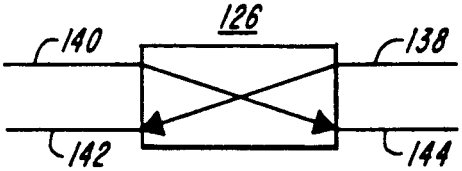

FIG. 6A and FIG. 6B illustrate a schematic diagram of the two states of direction valve unit 126. As detailed above, control unit 114 controls the state of direction valve unit 126 and thereby controls the direction of motion of air cylinder 112 along rod 120. In the first state, illustrated in FIG. 6A, when the direction of travel of air cylinder 112 is in the "positive" direction, then direction value unit 126 provides a pneumatic path (along lines 138 and 140) from pressurized source unit 116 directly to port assembly 128 and further provides a pneumatic path (along lines 142 and 144) from valve assembly 130 to velocity valve unit 124.

In the second state, illustrated in FIG. 6B, when the direction of travel of air cylinder 112 is in the negative direction, then direction valve unit 126 provides a pneumatic path from pressurized source unit 116 to port assembly 130 and further provides a pneumatiC path from port assembly 130 to velocity valve unit 124. Direction valve unit 126 for example may be a 4-way solenoid valve.

Figure 7A:
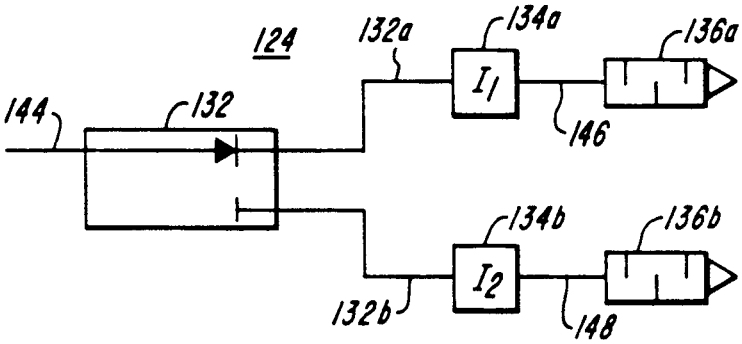
FIGS. 7A and 7B are schematic diagram representations of a preferred embodiment of the two state velocity valve unit of the actuator of FIG. 5.
Figure 7B:
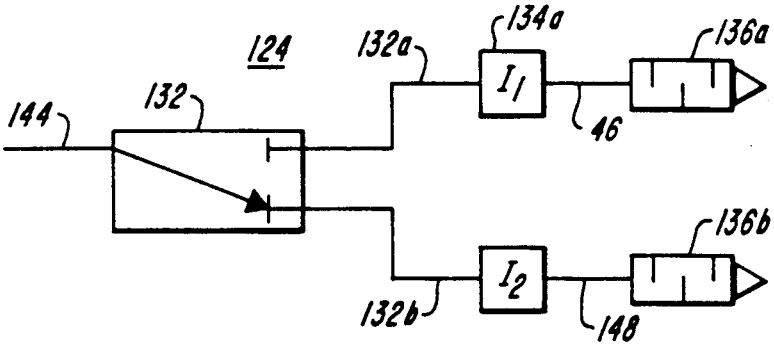

In the illustrated embodiment, as shown in detail in FIGS. 7A and 7B, velocity valve unit 126 includes a pneumatic valve 132, pneumatic impedance devices 134*a* and 134*b*, and exhaust/muffler assemblies 136*a* and 136*b*. Pneumatic valve 132 for example may be a 3-way solenoid valve in which the internal paths are selectively coupled between the external lines.

FIGS. 7A and 7B illustrate a schematic diagram of the two states of velocity valve unit 124 utilizing a 3-way solenoid valve. As detailed above, control unit 114 controls the state of velocity valve unit 124 and thereby controls the velocity of motion of air cylinder 112 along rod 120. Each state of velocity valve unit 124 connects a different pneumatic impedance between pneumatic line 144 and the atmosphere.

In the first state, illustrated in FIG. 7A, velocity valve unit 124 incorporates a pneumatic impedance of $I_1$ established by device 134*a*. In the second state, illustrated in FIG. 7B, velocity valve unit 124 incorporates a pneumatic impedance of $I_2$ established by device 134*b*. It should be noted that more than two states may be obtained utilizing a plurality of solenoid valves in configurations which are apparent to those skilled in the art.

With the above described configuration, a high efficiency and high reliability position control system may be established as a low complexity configuration using low cost components. There is no need for expensive electrical power supplies, high power switching devices, and heat sinks as are required in pneumatic controller system of the prior art. The invention can be much smaller than an electrical system for the same amount of power since an electric motor has winding losses that are roughly proportional to its power output so it must be large enough to dissipate the heat.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. Apparatus for locating a corner of a workpiece on a substantially planar worksurface, said worksurface being characterized by a first reflectivity and said workpiece being characterized by a second reflectivity, comprising:

A. gripper overlying said worksurface and including means for selectively gripping said workpiece, and an associated two axis transport assembly affixed thereto, said transport assembly including means for maintaining the angular orientation of said gripper with respect to said worksurface substantially constant, said means being responsive to applied position control signals for selectively positioning said gripper with respect to said worksurface in the direction of a first reference axis and for selectively positioning said gripper with respect to said worksurface in the direction of a second reference axis, said first and second axes being parallel to said worksurface, B. means for directing radiation toward said workpiece and said worksurface from above said worksurface, C. first sensor affixed to said gripper and including means for detecting said radiation reflected from portions of said workpiece and said worksurface and underlying a first region associated with said gripper, and for generating a first sensor signal representative thereof, D. second sensor affixed to said gripper and spaced apart in both said first and second direction from said first sensor and including means for detecting said radiation reflected from portions of said workpiece and said worksurface underlying a second region associated with said gripper, and for generating a second sensor signal representative thereof, and E. control means responsive to said first and second sensor signals for translating said gripper on said worksurface in the direction of said first reference axis until a transition in the intensity of detected radiation is identified by said first sensor, and in the direction of said second reference axis until a transition in the intensity of detected radiation is identified by said second sensor, whereby said gripper overlies a predetermined corner of said oriented workpiece.

2. Apparatus according to claim 1 wherein said two axis transport assembly includes means for selectively positioning said gripper in the direction of said first reference axis and in the direction of said second reference axis in response to applied position control signals; and said controller includes means for generating said position control signals whereby motion of said gripper is established in one or both of said first and second axes.

3. Apparatus according to claim 2 wherein said transport assembly includes a first position control system associated with said first reference axis and a second position control system associated with said second reference axis, each of said first and second position control systems including:

A. an air cylinder having a piston adapted for motion therein along its associated axis in a first direction in response to a pressure differential having a first polarity applied across a first port and a second port, and adapted for motion therein along its associated axis in a second direction in response to a pressure differential having a second polarity applied across said first port and said second port, B. first valve means responsive to a controller in a first state for selectively coupling said first port to a first air pressure and said second port to a second air pressure, and responsive to said controller in a second state for selectively coupling said first port to said second air pressure and said second port to said first air pressure, C. a controller including means for controlling the state of said first valve means, said controller being selectively operative to:

i. control said first valve means to be in said first state during a selected time interval, thereby establishing axial motion of said piston in said first direction during said interval, ii. control said first valve means to be in said second state during a selected time interval, thereby establishing axial motion of said piston in said second direction during said interval, iii. control said first valve means to be alternately in said first state and said second state during a selected time interval, thereby establishing substantially no motion of said piston during said interval.

4. Apparatus according to claim 3 wherein each of said position control systems further comprises:

D. second valve means responsive to said controller in a first state for selectively controlling the pneumatic impedance in the coupling path between at least one of said first and second ports and the air pressure coupled thereto to be a selected one of at least two predetermined values, and in a second state for controlling the pneumatic impedance in said coupling path to be another selected one of said predetermined values, wherein said controller is selectively operative to:

i. control said second valve means to be in said first state, thereby establishing a first velocity for said motion of said piston, ii. control said second valve means to be in said second state, thereby establishing a second velocity for said motion of said piston.

5. Apparatus according to claim 3 wherein each of said position control systems further comprises means for generating an actual position signal representative of the position of said piston along its associated axis.

6. Apparatus according to claim 5 wherein each of said controllers includes means responsive to said actual position signal and a signal representative of a desired position to control said first valve means whereby said piston is moved to and then maintained substantially at said desired position.

7. Apparatus according to claim 3 wherein each of said air cylinders is a double rod air cylinder including a housing defining an elongated cylindrical interior chamber having said first port near one end thereof and having said second port near the other end thereof, and including said piston within said chamber, said piston being adapted for motion along said piston axis within said chamber in response to said pressure differential across said first and second ports, said piston including a first rod extending from one side of said piston along an axis parallel to said piston axis and through one endwall of said housing and a second rod extending from the other side of said piston along an axis parallel to said piston axis and through the opposite endwall of said housing, said housing captively supporting a first seal between said first rod and said housing and captively supporting a second seal between said second rod and said housing.

8. Apparatus according to claim 7 wherein said first and second seals are lip seals.

9. Apparatus according to claim 3 wherein each of said air cylinders is characterized by relatively low sliding friction between its rod and housing and by relatively high static friction between its rod and housing.

10. A position control system according to claim 3 wherein each of said controllers is adapted to selectively control the duration and frequency of said time intervals whereby said established motions are substantially at predetermined velocities.

* * * * *